United States Patent [19]

Claudio

[11] Patent Number: 4,520,613

[45] Date of Patent: Jun. 4, 1985

[54] METHOD AND MACHINE FOR THE PACKAGING OF ARTICLES WITH A STRETCHABLE FOIL

[75] Inventor: Fuzzi Claudio, Lugano, Switzerland

[73] Assignee: Eurobeva Engineering Trust, Lugano, Switzerland

[21] Appl. No.: 285,059

[22] Filed: Jul. 20, 1981

[30] Foreign Application Priority Data

Jul. 18, 1980 [CH] Switzerland ..... 5506/80

[51] Int. Cl.[3] ..... B65B 41/14; B65B 41/04

[52] U.S. Cl. ..... 53/441; 53/461; 53/209; 53/556; 53/389; 198/627; 226/173

[58] Field of Search ..... 53/441, 389, 461, 465, 53/556, 329, 210, 203, 209; 198/627, 696, 653; 226/173

[56] References Cited

U.S. PATENT DOCUMENTS

| | | | |
|---|---|---|---|
| 1,961,661 | 6/1931 | Fuller . | |
| 2,017,459 | 10/1935 | Howe et al. | 226/173 X |
| 2,130,680 | 9/1938 | Ferenci . | |
| 2,301,106 | 11/1942 | Brown . | |
| 2,479,822 | 8/1949 | Enkur et al. | 198/627 |
| 2,486,758 | 11/1949 | Pfeiffer . | |
| 2,553,871 | 5/1951 | Sandberg . | |
| 2,627,709 | 2/1953 | Schlicksupp . | |
| 3,240,412 | 3/1966 | Zygan et al. | 226/173 X |
| 3,246,816 | 4/1966 | Dexter et al. | 226/173 X |
| 3,315,786 | 4/1967 | Hazelton | 198/627 X |
| 3,332,324 | 6/1967 | Lehmacher et al. . | |
| 3,444,666 | 5/1969 | Sarandos . | |
| 3,507,093 | 4/1970 | Marion | 53/329 X |
| 3,540,187 | 11/1970 | Monaghan | 53/210 X |
| 3,662,513 | 5/1972 | Fabbri . | |
| 3,673,760 | 7/1972 | Canamero et al. | 226/173 X |
| 4,042,124 | 8/1977 | Bowdry, III et al. | 198/627 X |
| 4,144,697 | 3/1979 | Suga | 53/556 |
| 4,336,680 | 6/1982 | Grevich | 226/173 X |

FOREIGN PATENT DOCUMENTS

| | | |
|---|---|---|
| 955764 | 7/1949 | France . |
| 270421 | 12/1950 | Switzerland . |
| 949921 | 2/1964 | United Kingdom . |

*Primary Examiner*—Horace M. Culver

*Attorney, Agent, or Firm*—Frishauf, Holtz, Goodman & Woodward

[57] ABSTRACT

In order to wrap dishes filled with fruit, meat or vegetables with a thin stretchable foil, a group of grippers carried on spaced endless chains are arranged to clamp the foil edges. The grippers are held in their foil gripping position each by a presser plate. The grippers transport the foil and hold it while the goods are raised thereagainst, stretching the foil. A cutter cuts off a foil section. It is situated in such a position that the severing operation is carried out at a position while the two foil edges are held fast by the grippers, thus facilitating the drawing forward of a foil, unwound from a supply roll.

13 Claims, 4 Drawing Figures

METHOD AND MACHINE FOR THE PACKAGING OF ARTICLES WITH A STRETCHABLE FOIL

The invention relates to a method and apparatus for the packaging of articles with a stretchable foil.

BACKGROUND

It is already known to use stretchable foils for the packaging of fruit or vegetables which are situated in containers of dish form. These foil sections, drawn from a supply roll and cut to the desired length, are stretched over the top of the filled dish. Then the dish is lifted on a lifting table and the foil edges are folded around the underside of the bottom of the dish and there adhered to one another by the action of heat.

The stretch foil, consisting of a soft synthetic plastic material must be very thin for this purpose so that it can adapt itself well to the articles with irregular surface to be packed, and nevertheless causes no pressure points on the packed material. Fruit, for example, is especially sensitive to this respect. On the other hand, the processing of such foils in packaging machines involves considerable difficulties on account of their softness, easy stretchability and deformability, and necessitates considerable machinery expense in order to avoid both tearing and undesired folding of the thin foil.

THE INVENTION

It is an object of the invention to further develop a method and a machine in which the handling of this thin foil in mechanical packaging is simplified and becomes less susceptible to troubles.

According to a feature of the invention, there is provided a method for the packaging of articles, especially fruit, vegetables or meat, comprising placing the articles into a container of dish form, drawing a foil from a supply roll by grasping two lateral foil edges extending in the direction of travel of the foil by a plurality of movable grippers arranged in opposed sets with spacing from one another, transporting a foil portion intermittently by these grippers, cutting off a foil section in the gripping region after the lateral foil edges have been grasped on both sides by at least on gripper, stretching the foil section over the container filled with articles, and folding the foil edges around the underside of the container.

According to another feature of the invention, there is provided a machine for the packaging of articles situated in a container of dish form, especially fruit, vegetables or meat, using a stretchable foil, comprising gripper devices having a plurality of grippers in the form of gripper tongs, or jaws, spaced from one another, which are arranged to grip lateral sides of the foil edges which extend in the direction of travel of the foil web, thus pulling the foil web off a roll. The grippers are secured to endless chains. A pressure plate located in a foil clamping region is pressable against the gripper tongs and liftable away therefrom to effect, respectivel, gripping or clamping of the foil and release of the clamping effect. A severing device is provided for severing a foil section from the foil web, and means are provided for wrapping the filled containers with the severed foil section.

The method according to the invention and the machine ensure that the foil remains constantly laterally grasped and tensioned, even after a foil section has been severed.

For the drawing-forward of a next foil section, the foil after cutting away of a foil section in each case thus does not need to be grasped afresh each time, but the already clamped foil, located behind the severing device, is merely drawn forward by the gripper tongs moving with the endless chains. The conversion to different packaging, or foil formats and the clamping and release of the foil become especially simple.

BRIEF DESCRIPTION OF THE DRAWINGS

An example of embodiment of the object of the invention is illustrated in the drawing, wherein.

DESCRIPTION OF A PREFERRED EMBODIMENT

Figure 1:
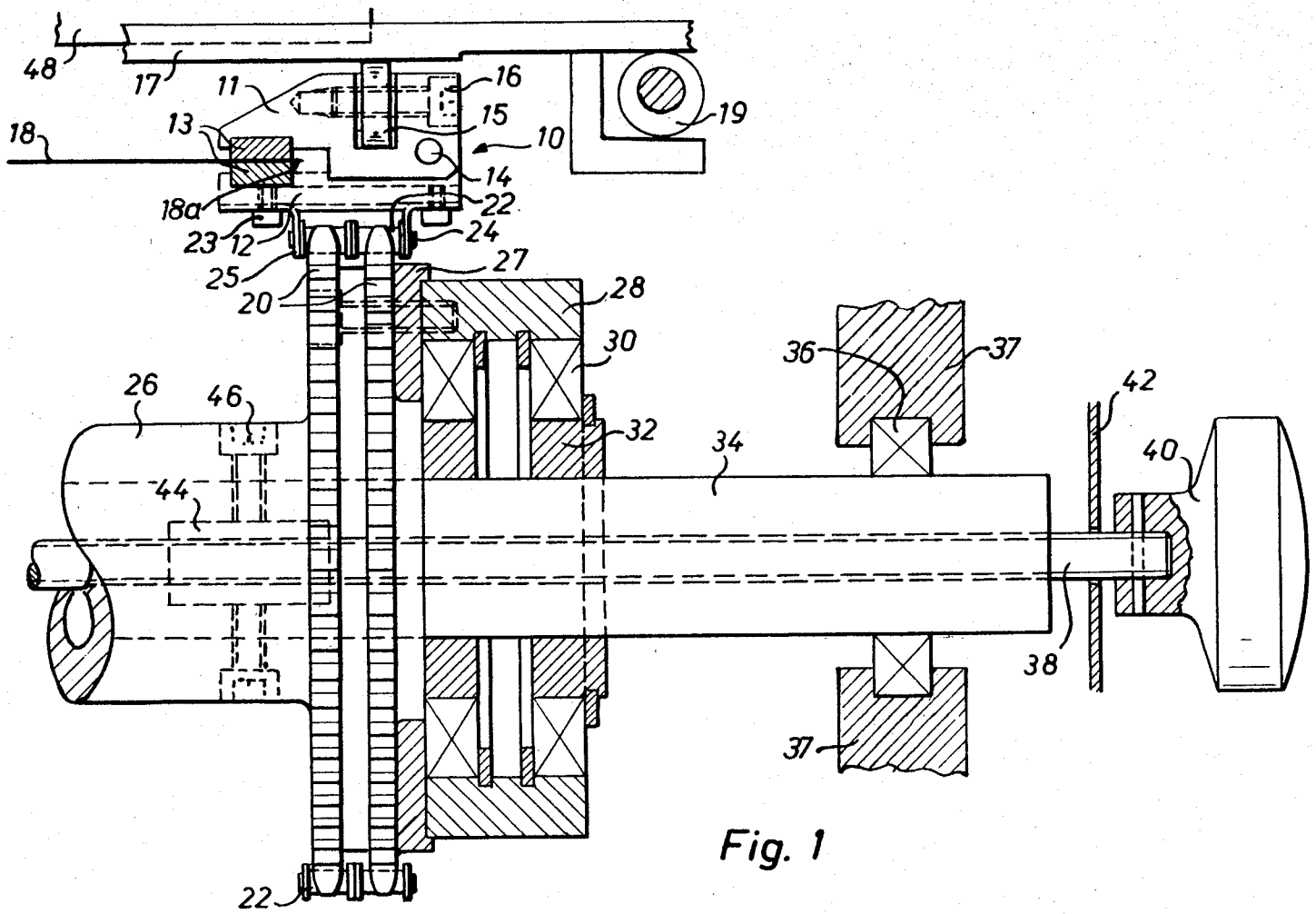
FIG. 1 shows a view of the foil gripper elements with drive and adjusting elements, partially in section.

A stretchable thin foil 18 is fed from a continuous foil web unreeled from a storage roll to a packaging station in which one or more articles, for example fruit, vegetables or meat, situated in a rectangular carrying tray or dish 52 consisting of cardboard, plastic material, or the like, and suitably located on a lifting table 50 are intended to be wrapped by a foil section of soft plastic. Then the end parts of the foil section are folded or wrapped around beneath the underside of the dish bottom and heat-affixed.

The foil 18 is unwound from a supply roll (not shown). The foil 18 is grasped laterally—that is to say, in the direction of movement of the foil web. See arrow B, FIG. 2—at at its two edge parts 18*a* (of which only one is shown) with the aid of a plurality of gripper tongs or jaws 10 which—according to FIGS. 1 and 2—are secured on endless chains 22. Transversely aligned gripper tongs form a pair or a set. The sets of gripper tongs 10 are spaced from each other and are fixed on a pair of chains 22. The endless chains 22 are arranged on both sides of the longitudinal edge parts 18*a* of the foil 18 and are guided each around chain reversing wheels 20 with horizontal axes of rotation so that a rectilinear upper and lower chain run is situated between each two chain reversing wheel pairs 20. The drive of the chain reversing wheels 20 takes place intermittently in synchronism with the working cadence of the packaging machine.

Figure 2:
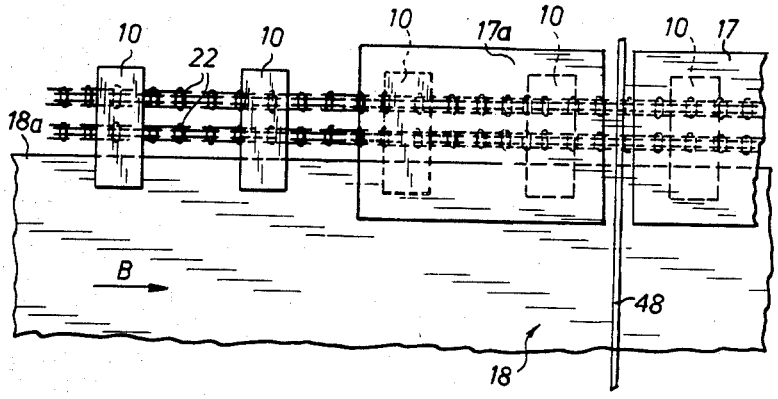
FIG. 2 shows a plan view of the gripper tongs, the cutter and the presser plates.

The upper jaw part 11 of each of these gripper tongs 10 can be pivoted in relation to its lower jaw part 12 about a pivot axis 14 (FIG. 1). If the foil 18 is to be clamped fast between the upper and lower clamping jaws 13 of a gripper tong 10, the upper part 11 is pressed downwardly against the lower part 12 by a presser plate 17, upon engagement of a roller 15 therewith. The roller 15 is rotatably held by a screw 16 in the upper part 11. The screw 16 exends transversely of the direction of the feed of the foil 18 so that the roller 15 can roll off underneath the presser plate 17, parallel with the chain 22. In place of a roller 15, the upper part 11 can also rest directly against the presser plate 17. To reduce friction, the upper part 11 is then preferably made of a synthetic plastic material. The lower parts 12 of the gripper tongs 10 are secured on the respective double chain 22 by fastening bolts 24, angle pieces 25 and screws 23. Since the chain reversing wheels 20 are formed as double chain wheels, the gripper tongs 10 are guided securely. On the opposite edge of the foil 18 there are similar gripper tongs, chains and chain wheels. For reasons of better clarity only, the one side will be described below, since the other side is of like formation.

The presser plate 17 is held in position with the aid of two eccentrics 19 situated on opposite ends in a lower position so that the foil 18 is situated between the two clamping jaws 13 is clamped fast. To permit threading of the foil, and folding, the clamping action of plate 17 can be released if the eccentrics 19 are rotated to place plate 17 into non-clamping position. When a dish with its contents is brought into wrapping position and situated beneath the foil 18, and together with the material therein is lifted vertically by a lifting table 50, the foil 18 is released after the desired foil tension is reached upon rotation of eccentric 19. Preferably, a separate presser plate 17 is allocated to each set of the gripper tongs 10 at the two foil edges 18*a*. The separate presser plates are displaceable by mutually independently actuatable eccentrics 19. This permits liberation of the two longitudinal edges 18*a* of the foil 18 at different moments in time. The presser plates 17 can be pressed upon and lifted away from the gripper tongs 10 by means other than eccentrics 19, for example by cam discs, electromagnets, or hydraulic or pneumatic cylinder-piston units.

For the severing of a foil section from the web, a cutter 48, extending transversely of the direction of feed of the foil 18, is provided. This cutter is moved downwards between two adjacent gripper tongs 10 and thus severs the foil 18. The movement and correctly timed control of the severing operation are effected by cam discs. Preferably, a non-displaceable counter-cutter (not shown in the drawing) for the cutter 48 is located beneath cutter 48. The arrangement of the cutter 48 is made such that—seen in the foil transport direction—it is arranged behind the first or second gripper tong pair which clamp the foil 18 fast on both sides, but in advance of the presser plate 17, which engages the tongs holding the severed foil section over the goods to be wrapped, as appears from FIG. 2.

So that foils 18 of different widths may be used, the lateral interval of the chain wheels 20 and thus of the gripper tongs 10 is variable. The adjustment takes place according to FIG. 1 with the aid of a hand wheel 40 which is connected fast for rotation with a threaded spindle 38. This thread spindle 38 penetrates coaxially a shaft 34 and engages in a threaded nut 44 which is supported with the aid of retaining screws 46 in a hub 26 carrying the chain wheels 20. A support ring 28 is screwed by means of a spacer ring 27 with the one double chain wheel 20. Two rolling bearings 36 are held in this support ring 27 which are inwardly supported by rings 32 and which are displaceable on the shaft 34 in the axial direction. The shaft 34 is supported through at least one rolling bearing 36 by a non-displaceable machine part 37. Upon rotation of the hand wheel 40 which is situated outside the casing 42, thus, the double chain wheel 20 can be displaced in the axial direction.

A double chain wheel arranged in mirror image and situated on the other foil edge is displaced axially in the opposite direction with a reversely pitched thread on the same threaded spindle 38, so that, upon rotation of the hand wheel 40 in respective directions, the mutual distance of the chain wheels 20 is reduced or enlarged.

Figure 3:
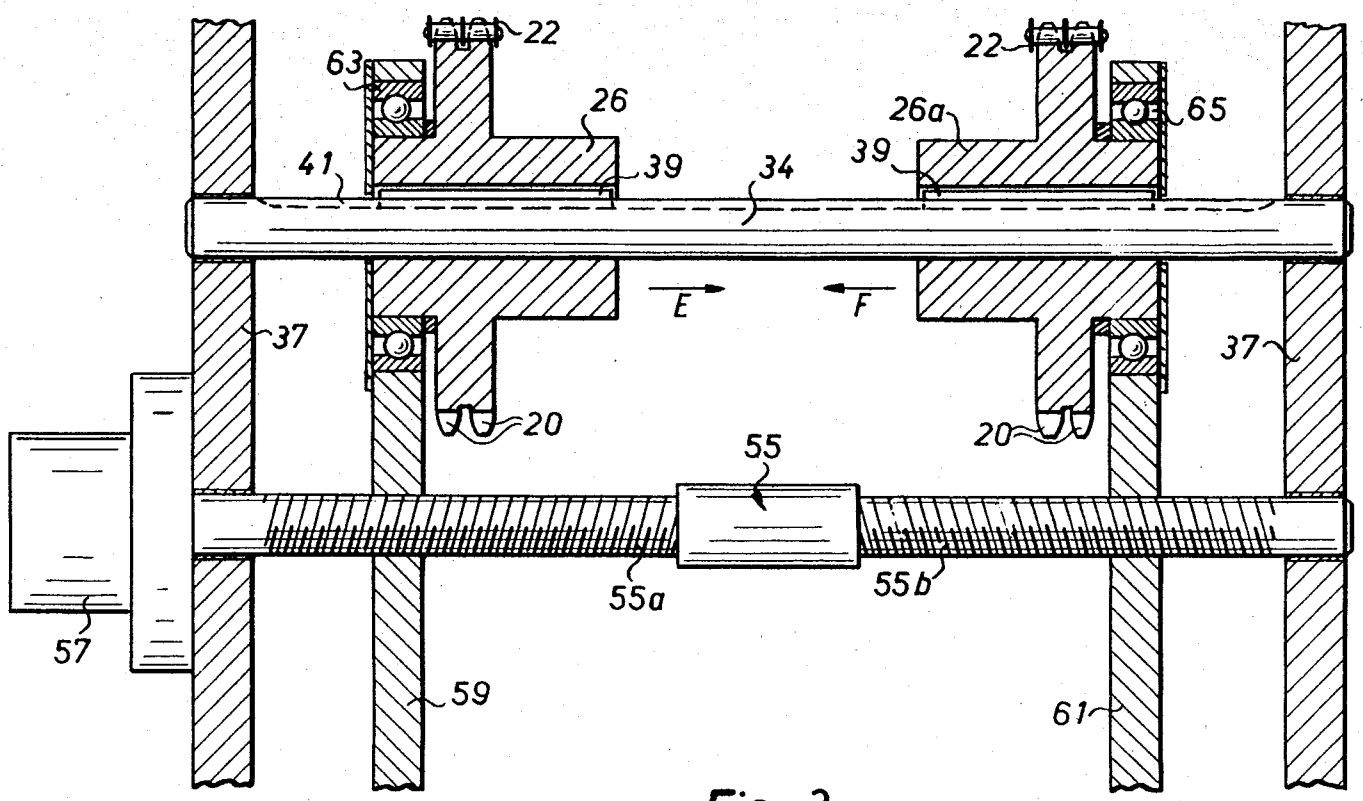
FIG. 3 shows a horizontal section through the adjusting device for the use of different foil widths.

FIG. 3 shows a variant, viz. a motor-driven adjusting device for varying the lateral distance between the two chain pairs 22 carrying the gripper tongs 10. The two hubs 26, 26*a* carrying the chain wheels 20 are seated on a shaft 34 which is mounted rotatably in the machine housing 37. Between each of the hubs 26, 26*a* and the shaft 34 there is situated a key or spline 39 which is displaceable in respective keyways 41 of the shaft 34. A threaded spindle 55 arranged parallel with and at a distance from the shaft 34 is likewise rotatably mounted in the machine housing 37 and is in drive connection with an electric motor 57. The one half of this threaded spindle 55 has a right hand thread 55*a* and the other half a left hand thread 55*b*. One thread half engages a carrier 59, and the other thread half engages a parallel carrier 61. The carrier 59 is connected through a ball bearing 63 with the hub 26 while the carrier 61 cooperates through a ball bearing 65 with the hub 26*a*. The carriers 59 and 61 each carry a further hub with chain wheels at a position no longer visible in the drawing, from which the drive takes place.

When the motor 57 is switched on, the two hubs 26, 26*a* move in the direction of the arrows E and F. On a change of direction of rotation of the motor, the two hubs 26, 26*a* are displaced in opposite directions. Thus, the lateral spacing of the gripper tongs 10 can be varied by motor drive to adapt the machine to different foil widths.

Figure 4:
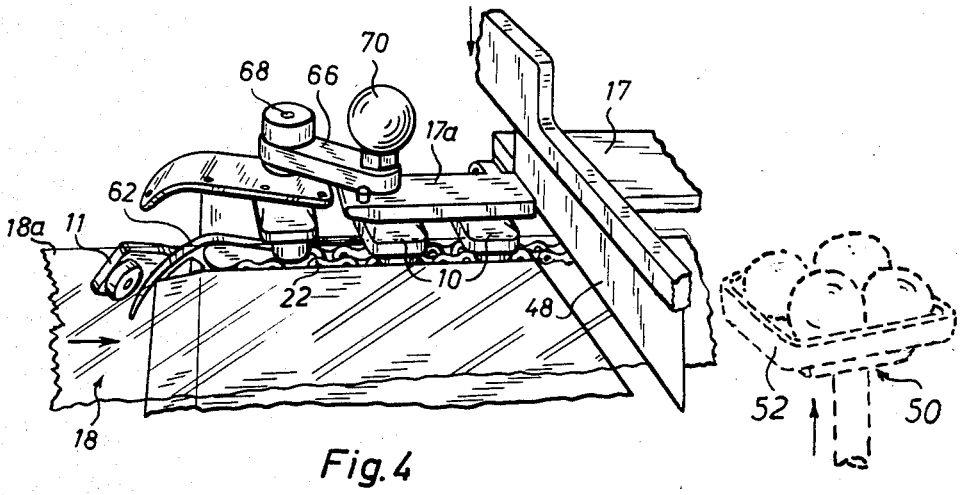
FIG. 4 shows a view of the region of introduction of the foil into the gripper tongs.

It can best be seen from FIG. 4, the upper part 11 of the gripper tongs 10 comes to bear against a cam 62 arranged before an initial presser plate part 17*a*. The gripper tongs 10, previously open under their own weight and moved upwardly along the chain reversing wheels 20 from below, remain opened until they are situated in the region of the rectilinearly fed foil 18. Foil 18 usually is transparent. The initial actual pressing force of the gripper tongs 10 against the foil edge parts 18*a* is generated by the initial or forward presser plate part 17*a* and continued by presser plate 18 adjoining the cam 62. In order to facilitate the threading-in of the foil 18, e.g. when changing the foil, a pivot plate 66 is provided which can be pivoted about a vertical bolt 68 out of the region of the pressure plate part 17*a*, by operating a ball handle 70. The pressure plates 17, 17*a* at each longitudinal edge of the foil are so arranged that the initial and short pressure plate part 17*a* is pivotable about a horizontal pivot axis. The pressure plate 17 is movable in vertical direction by the cams 19 (FIG. 1). Thus, after lifting the pressure plate part 17*a*, the upper part 11 of the gripper tongs 10 can be lifted by hand for the introduction of the foil 18. After the first gripper tongs 10 has grasped the foil, the pivot plate 66 is brought into the position as illustrated in FIG. 4, so that it can exert a clamping force on the pressure plate part 17*a* and the gripper tongs 10 for clamping the foil 18, which then can be transported in direction of arrow B.

I claim:

1. Method for packaging of articles, especially fruit, vegetables or meat, placed in a dish-like container comprising (1) grasping two lateral edges of a leading foil portion, projecting from a roll, by a first set of at least two gripper tongs, positioned transversely—with respect to the longitudinal extent of a foil—said at least two gripper tongs being part of a plurality of sets of movable gripper tongs arranged, with spacing, from one another;

(2) intermittently transporting the gripper tongs over the dish-like containter and drawing off the foil from the roll;

(3)grasping further foil portions downstream of the leading foil portion, subsequent to the first grasped foil portion, by succeeding sets of gripper tongs;

(4) cutting off and severing a leading foil section from the leading foil portion in the region of the grasped portions after the lateral foil edges of the further foil portions have been grasped on both sides by at least one succeeding set of gripper tongs while continuing to grasp both the leading foil section and the further foil portions by the respective sets of gripper tongs, the step of cutting the foil section being carried out after the step of grasping the further foil portions;

(5) stretching the then severed leading foil section over the container filled with the articles; and (6) releasing the grasp of the gripper tongs on the foil section to permit folding the foil edges around the underside of the container.

2. Method according to claim 1, wherein the cutting step is carried out by operating a cutter extending transversely to the foil when adjacent sets of gripper tongs have moved to a position on either side of the cutter, to place the cutter in the spacing between said sets of gripper tongs.

3. Method according to claim 1, wherein the step of releasing the grasp of the gripper tongs comprises releasing the gripper tongs grasping one lateral edge of the foil, in time, after release of the tongs on the other lateral edge of the foil.

4. Machine for packaging of articles located in a dish-like container (52), especially fruit, vegetables or meat, using a stretchable foil (18) comprising means (50) for supporting said container (52);

a plurality of sets of gripper tongs (10) spaced from one another, which are arranged to grip lateral sides of the edges (18*a*) of the foil (18) and extending in a direction of unrolling of a foil portion from said foil roll;

endless chains (22) for supporting said gripper tongs (10) located at respective sides of the foil edges in the direction of travel of the foil;

presser plate means (17, 17′) engageable with the gripper tongs (10) to effect clamping of the lateral foil edge portions (18*a*) by the gripper tongs (10);

cam means (19) engageable with said presser plate means (17) for selectively moving the presser plate means towards and away from the gripper tongs (10) and thereby effect, respectively, clamping of the gripper tongs on the edges (18*a*) of the foil (18) to transport the foil by the gripper tongs, moved by the endless chain (22) and stretching of the foil over the container (52) filled with the articles, and release of the foil to permit folding of the foil over the filled container;

the gripper tongs (10) comprising a lower part (12) and an upper part (11), one of said parts being rigidly secured to the chain (22) and the other of said parts being movable relatively to said rigidly secured part, said movable part being engageable with said presser plate means (17, 17′);

and a movable cutter device (48) for severing a foil section from the foil web (18) to permit folding of the then severed foil section and wrapping of the filled container with the severed foil, said cutter device (48) being located in the region in which at least one set of gripper tongs (10) has grasped the lateral edges of the foil upon unreeling of the foil from the roll and positioned behind—in the direction of unrolling of the foil from the foil roll—that one of the gripper tongs which grips a leading portion of the foil, to provide for continued gripping of a severed foil section by some of the gripping tongs, while foil portions downstream of the severed section are continued to be gripped;

and wherein the movement of the cutter device for severing the foil section, and the movement of the endless chain supporting said gripper tongs, in synchronized to place the cutter into cutting position when the cutter is located between a pair of sets of gripper tongs spaced longitudinally—in the direction of unrolling of the foil—along the foil.

5. Machine according to claim 4, wherein said presser plate means comprises two presser plate elements (17, 17*a*), one of which is in advance of the cutter device (48).

6. Machine according to claim 5, wherein one of the presser plate elements is shorter than the other;

and means are provided for moving the shorter one of the presser plates out-of-engagement with the gripper tongs to facilitate threading of the foil into the machine.

7. Machine according to claim 4, wherein the cam means (19) controlling the presser plate means (17, 17′) to, in turn, control opening of the gripper tongs (10) at the two lateral edges (18*a*) of the foil (18), control a portion (17′) of the presser plate means to open the gripper tongs at one lateral edge of the foil (18*a*), in time, after release of the gripper tongs at the other lateral edge of the foil.

8. Machine according to claim 4, further comprising adjusting means for changing the mutual distance of the chains, and thus of the gripper tongs, and adapt the gripper tongs and the chains to different widths of foil.

9. Machine according to claim 8, wherein the adjusting means includes a threaded spindle;

and sprocket chain wheels engageable with said chain means the threaded spindle being coupled to the sprocket chain wheels to displace the sprocket chain wheels in axial direction.

10. Machine according to claim 4, further including means for varying the width of the spacing of the endless chains including chain wheels (20) carrying said chains, and axially spaced from each other;

hubs on said chain wheels;

and means axially displacing said hub comprising a threaded spindle having, respectively, left and right-hand threads engaged in said hubs;

and electric motor drive means to rotate the threaded spindle in either direction of rotation to thereby axially displace the hubs, and with it the chain wheels.

11. Machine according to claim 4, further including a cam element, located to engage the movable part of the gripper tongs, and positioned at the region of initial engagement of the sets of gripper tongs with the lateral edges of the foil and in advance of the position of the presser plate means.

12. Machine according to claim 4, wherein the said gripper tongs are carried with said chain around a reversing wheel;

and further including a deflecting cam located in advance of the presser plate means and adjacent the reversing wheel to deflect the upper part of the gripper tongs to open position before engagement thereof with the presser plate means to permit grasping the foil edges between the lower part of the gripper tongs and the then opened upper part thereof.

13. Machine according to claim 4, wherein said cutter device is positioned in advance of the presser plate means.

* * * * *

UNITED STATES PATENT AND TRADEMARK OFFICE

CERTIFICATE OF CORRECTION

PATENT NO. : 4,520,613

DATED : June 4, 1985

INVENTOR(S) : Claudio FUZZI

It is certified that error appears in the above-identified patent and that said Letters Patent is hereby corrected as shown below:

On the title page;

Please correct the name of the inventor to read:

--Claudio FUZZI--.

Signed and Sealed this

*Twenty-third* Day of *July 1985*

[SEAL]

*Attest:*

DONALD J. QUIGG

*Attesting Officer*

*Acting Commissioner of Patents and Trademarks*